US006401276B1

(12) United States Patent
Sherman

(10) Patent No.: US 6,401,276 B1
(45) Date of Patent: Jun. 11, 2002

(54) TRANSFIGURABLE FURNITURE UNIT

(76) Inventor: Loren Sherman, 685 W. End Ave., No. 1B, New York, NY (US) 10025

( * ) Notice: Subject to any disclaimer, the term of this patent is extended or adjusted under 35 U.S.C. 154(b) by 0 days.

(21) Appl. No.: 09/662,537

(22) Filed: Sep. 15, 2000

Related U.S. Application Data

(63) Continuation-in-part of application No. 09/476,757, filed on Jan. 3, 2000, now abandoned.

(51) Int. Cl.[7] ..... A47C 17/42; A47C 17/40
(52) U.S. Cl. ..... 5/136; 5/2.1; 5/133; 5/164.1
(58) Field of Search ..... 5/136, 133, 159.1, 5/2.1, 160, 161, 164.1

(56) References Cited

U.S. PATENT DOCUMENTS

| | | | | | |
|---|---|---|---|---|---|
| 244,566 | A | * | 7/1881 | Doring | 5/2.1 |
| 562,269 | A | * | 6/1896 | Auerbach | 5/167 |
| 1,419,586 | A | * | 6/1922 | Plackard | 5/2.1 |
| 1,820,672 | A | * | 8/1931 | Muchlinski | 5/140 |
| 1,915,507 | A | * | 6/1933 | Wright | 5/133 |
| 2,564,512 | A | * | 8/1951 | Specht | 5/2.1 |
| 2,671,230 | A | | 3/1954 | Potter | 5/141 |
| 2,770,813 | A | | 11/1956 | Marzillier | 5/2.1 |
| 3,046,572 | A | * | 7/1962 | Eames et al. | 5/136 |
| 3,088,127 | A | | 5/1963 | Eames | 5/2.1 |
| 3,550,167 | A | * | 12/1970 | Bennett | 5/136 |
| 3,858,253 | A | * | 1/1975 | Lauzon | 5/2.1 |
| 4,070,715 | A | | 1/1978 | Reppas | 5/2.1 |
| 4,318,195 | A | | 3/1982 | Reppas | 5/2.1 |
| 4,476,592 | A | | 10/1984 | Reppas et al. | 5/164.1 |
| 4,553,278 | A | * | 11/1985 | Drexhage | 5/136 |
| 4,885,813 | A | * | 12/1989 | McNamara | 5/136 |
| 5,101,523 | A | | 4/1992 | Bright | 5/2.1 |
| 5,136,737 | A | | 8/1992 | Reppas et al. | 5/2.1 |
| 5,446,932 | A | * | 9/1995 | Voorhis | 5/137 |
| 5,621,930 | A | | 4/1997 | Reppas et al. | 5/136 |
| 5,652,978 | A | * | 8/1997 | Wiig | 5/144 |
| 6,212,710 | B1 | * | 4/2001 | Jones | 5/136 X |

* cited by examiner

*Primary Examiner*—Robert G. Santos
(74) *Attorney, Agent, or Firm*—Notaro & Michalos P.C.

(57) ABSTRACT

A convertible furniture unit has a base and a bed platform pivotally connected to the base for angular displacement about a first axis from an upright stowed position with respect to the base, to a substantially horizontal use position. The platform has an upper surface in the use position that is adapted to support a mattress, and an opposite surface. A table panel has a first end that is pivotally mounted to the opposite surface of the platform for relative displacement between the platform and the panel about a second axis which is spaced from the first axis so that the panel is in a support position when the platform is in the use position, and the panel is in a working position when the platform is in the stowed position. An extension or foot is pivotally connected to the table panel at a location that is spaced from the first end of the panel, for rotation of the extension or foot between an upper position for propping the panel in its working position, and a lower position. The extension or foot pivots about a third axis which is spaced from the first and second axes and includes a part for supporting the panel in the support position when the extension or foot is in its lower position.

26 Claims, 15 Drawing Sheets

TRANSFIGURABLE FURNITURE UNIT

CROSS-REFERENCE TO RELATED APPLICATION

This is a continuation-in-part of U.S. patent application Ser. No. 09/476,757 filed Jan. 3, 2000 now abandoned.

FIELD AND BACKGROUND OF THE INVENTION

The present invention relates in general to transformable furniture., and in particular, to a new and useful furniture unit that converts between a bed position and a table position.

Convertible furniture is commonly utilized as a space-saving expedient, for example, in living quarters having limited space, such as in studios and in small apartments that are frequently found in densely populated urban areas. A typical example of such convertible furniture is the conventional sofa-bed which provides a sofa in one mode and a bed frame and mattress in another mode.

Convertible furniture which converts from a bed to a desk may also be used in larger homes for double-use rooms, such as a guest room/home office combination.

A convertible furniture unit having both a desk and a bed function is illustrated in U.S. Pat. No. 4,318,195. This furniture unit does not provide a minimal storage profile and is cumbersome to operate. It also does not include the convenience of a head-board.

U.S. Pat. No. 2,671,230 discloses a wall bed which employs tension springs to facilitate movement of the bed between stowed and open positions. The hinged leg assembly support for this bed frame and its chain support for a shelf have only moderate weight-bearing capacity and rather limited stability. A multi-functional convertible furniture construction is disclosed in U.S. Pat. No. 5,101,523. It incorporates a bed frame within a shelving unit. A movable extension attached to a spool in this construction must be unrolled to support a mattress. The mattress must also be foldably stored.

Also see U.S. Pat. Nos. 2,770,813; 3,088,127; 4,070,715 and 4,476,592 for other examples of convertible furniture units having a bed position.

SUMMARY OF THE INVENTION

The present invention is a convertible furniture unit that has a base and a bed platform pivotally connected to the base for angular displacement about a first axis from an upright stowed position with respect to the base, to a substantially horizontal use position. The platform has an upper surface in the use position that is adapted to support a mattress. A table panel has a first end that is pivotally mounted to an opposite surface or underside of the platform for relative displacement between the platform and the panel about a second axis which is spaced from the first axis so that the panel is in a support position when the platform is in the use position, and the panel is in a working position to serve as a table, desk or work surface when the platform is in the stowed position. An extension or foot is pivotally connected to the table panel about a third axis at a location that is spaced from the first end of the panel, for rotation of the extension or foot between an upper position for propping the table panel in its working position, and a lower position. The extension or foot pivots on the table panel about the third axis which is spaced from the first and second axes and includes a part for supporting the table panel and the bed platform thereon, in its support position when the extension or foot is in its lower position.

The table panel can be a solid board, an engineered panel of laminates and frame or a three-dimensional structure with spaces for drawers, storage areas or the like. It can be used as a dining table, writing table, desk, work surface or similar article of furniture. The table panel includes a second end or edge, opposite to the first end. When the bed platform is moved to the lowered use position, the extension and a leg fixed to the extension are automatically folded to a load-bearing mode for supporting the bed platform. Concurrently with the movement of the bed platform, a head-board with top shelf is deployed. A stiffener or spreader member or means is forwardly extendable for stabilizing the furniture unit in one embodiment of the invention. In another embodiment, the spreader is fixed to the base and extends under the table panel permanently to support the table panel in both its working and support positions. In still another embodiment, the foot is fixed directly to the floor without the use of a spreader member. For ease of reference, this embodiment is also referred to as using "spreader means" in the sense that the distance between the foot and the base is fixed. This fixed spreader means better allows the unit to be free standing. In the first embodiment which also allows the table panel to move up into a stored position, the base, could be fastened to the wall for extra safety. A spring, an optional damping device and/or a counterweight are utilized for controlling movement of the bed platform to and from the upright stowed position and the horizontal use position. Alternatively, a motor driven activator can be employed to raise and lower the bed platform.

When the bed platform and mattress, and, in the first embodiment of the invention, the table panel are in the stowed and stored positions, they are substantially housed within the base and provide a self-supporting furniture unit. As noted, the furniture unit can be attached to a wall and/or recessed within a wall. In the other embodiments of the invention which use fixed spreaders, the base may be full height or need not be as high and may only be as high as a head-board for the unit.

In view of the foregoing, it should be apparent that the present invention overcomes many of the limitations of the previously known convertible furniture designs and provides an improved transfigurable furniture unit.

Accordingly, a general object of the invention is to provide a transfigurable or convertible furniture unit which converts between different functional modes.

Another object of the invention is to provide a convertible furniture unit having a table and/or a desk configuration in one mode and a bed configuration in another mode.

Still another object of this invention is to provide a convertible furniture unit wherein counterbalancing forces are equalized when in either of the functional and the stowage modes.

A further object of this invention is to provide a transfigurable furniture unit wherein the table configuration is transformable for supporting the bed platform.

A still further object of this invention is to provide a transfigurable furniture unit having a head-board that is concurrently deployable with the bed platform.

Another object of the invention is to provide a transfigurable furniture unit that is simple in design, rugged in construction and economical to manufacture.

The various features of novelty which characterize the invention, are pointed out with particularity in the claims annexed to, and forming a part of this disclosure. For a better understanding of the invention, its operating advantages and specific objects attained by its uses, reference is made to the accompanying drawings and descriptive matter, in which preferred embodiments of the invention are illustrated.

DESCRIPTION OF THE PREFERRED EMBODIMENTS

Figure 1:
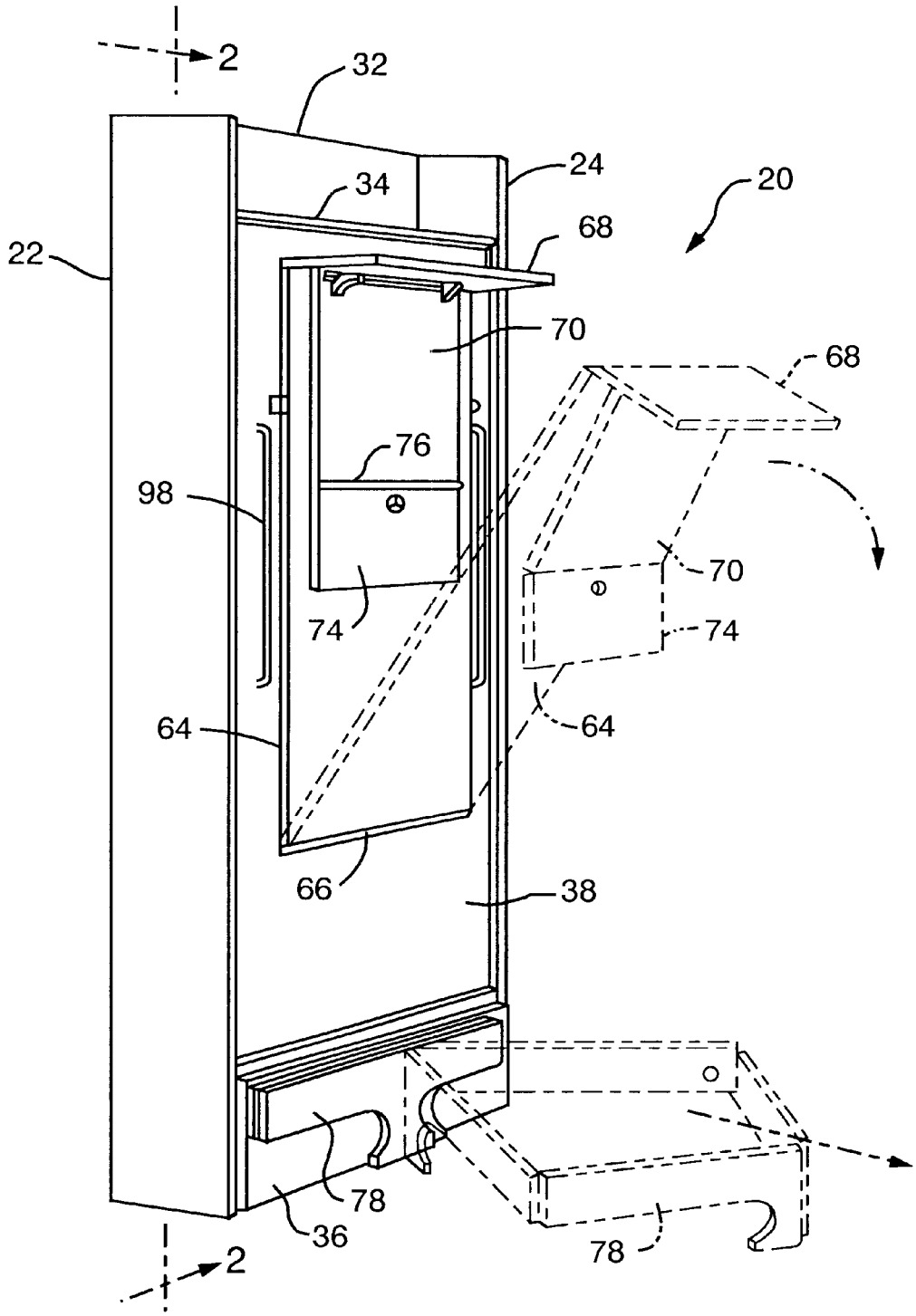
FIG. 1 is a perspective view of a first embodiment of the transfigurable furniture unit in accordance with the invention in a stowage mode and illustrating, in broken-line, the initiation of movement to the functional modes.
Figure 3:
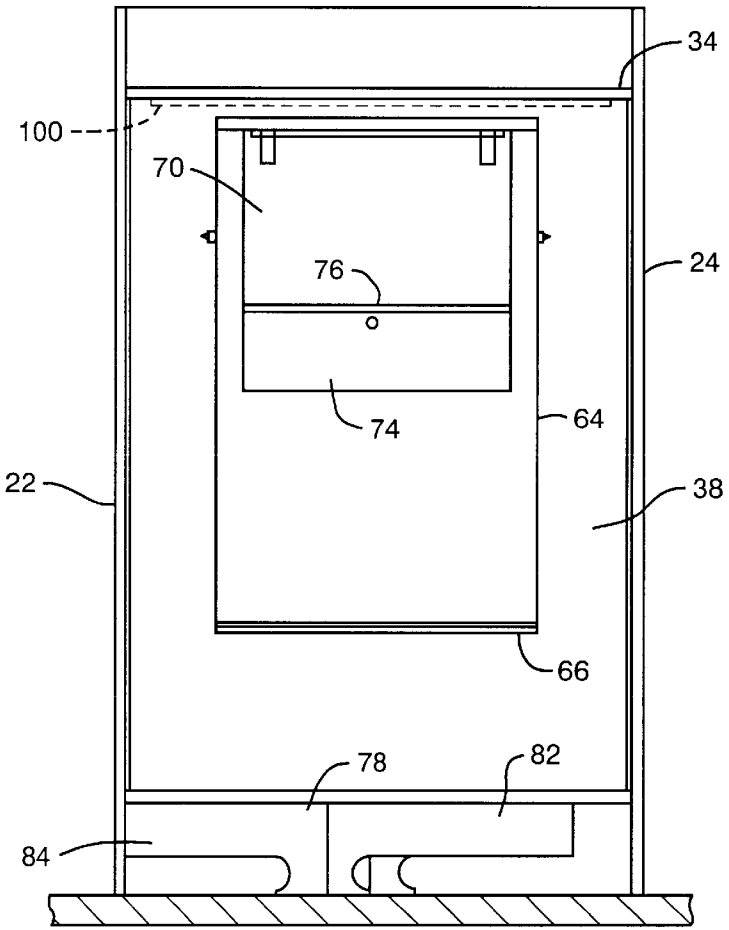
FIG. 3 is a front elevational view showing a table panel in a vertically stowed position and a stiffener assembly in a folded position.
Figure 2:
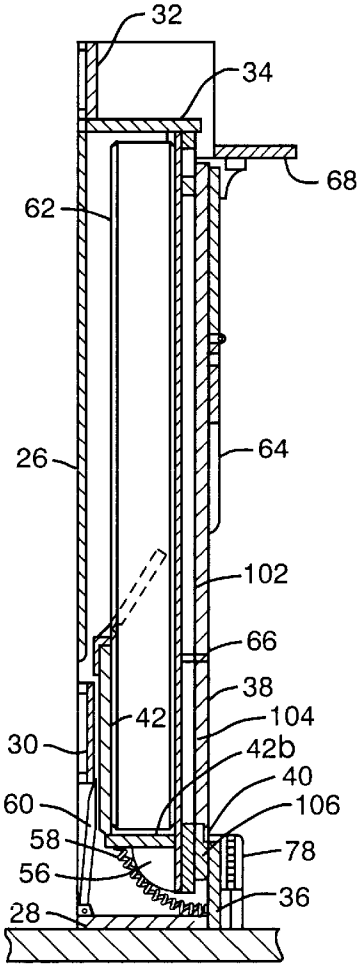
FIG. 2 is a sectional view taken along line 2—2 of FIG. 1 showing a bed platform and a mattress in an upright stowed position.

Referring now to the drawings in which the same reference numerals are used to designate the same or functionally similar parts, the invention embodied therein, in FIGS. 1 and 2, comprises a transfigurable furniture unit generally designated 20, in accordance with a first embodiment of the invention. The furniture unit 20 includes a base having two spaced-apart upright side panels 22, 24 and a back panel 26 that is connected to and extends between the side panels 22, 24. As shown in FIG. 2, a base plate 28, optional lower cross-brace 30 and optional upper cross-brace 32, provides structural integrity for the base. A shelf member 34 and a sill plate 36 also contribute to the strength and stability of the furniture unit base.

Back panel 26, as shown, does not extend the full height of the side panels 22, 24. However, the area below the back panel 26 will not be exposed when the furniture unit 20 is in the functional mode. Alternatively, the furniture unit 20 is to be placed adjacent a wall or with a full height back panel 26 if the furniture unit 20 is to be used as a room divider.

Figure 4:
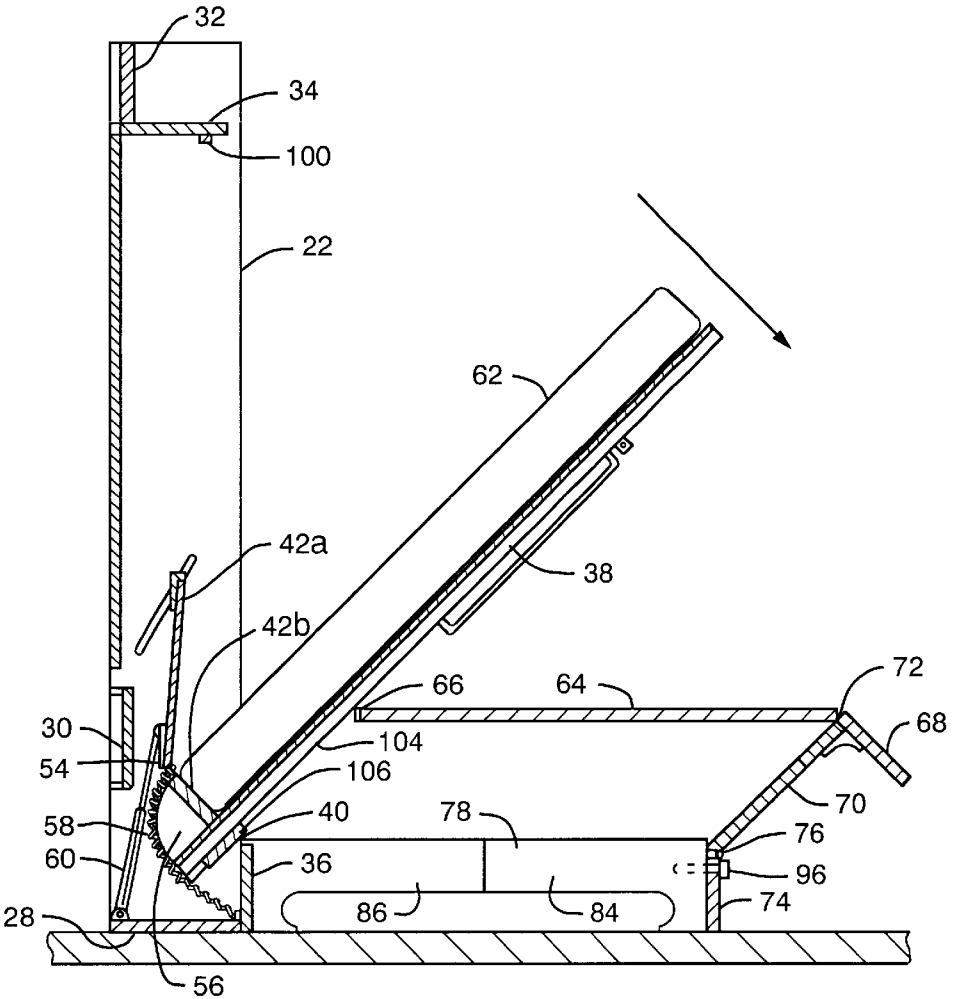
FIG. 4 is a side elevational view, partly in section, showing the bed platform and the mattress during their transitional movement.
Figure 7:
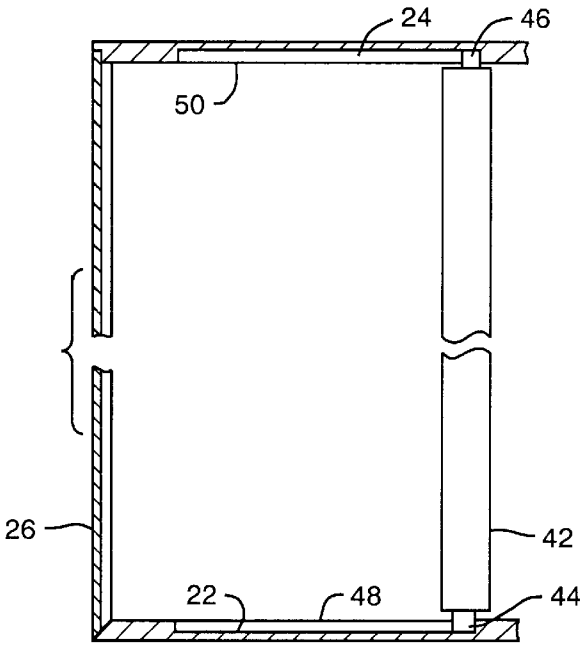
FIG. 7 is an auxiliary view, taken along line 7—7 of FIG. 5, with a portion broken away.

Referring now to FIG. 4, a substantially planar bed platform 38 is pivotally connected at a first axis 40, to the sill plate 36 for movement about this horizontal axis. A head-board 42 is attached to the. bed platform 38. An upper component 42*a* of the head-board 42 is provided with laterally projecting guide rods 44, 46. The guide rods 44, 46 are slidably accommodatable within respective tracks or slots 48, 50 that are routered or otherwise provided in the respective side panels 22, 24 as shown in FIG. 7. A lower component 42*b* of the head-board 42 defines a backstop and is pivotally connected at 54 to the upper component 42*a* of the head-board 42. The backstop 42*b* is buttressed by a gusset formed as a quarter circle block 56 mounted at each of the opposed ends of the backstop 42*b* as shown in FIG. 6.

Figure 5:
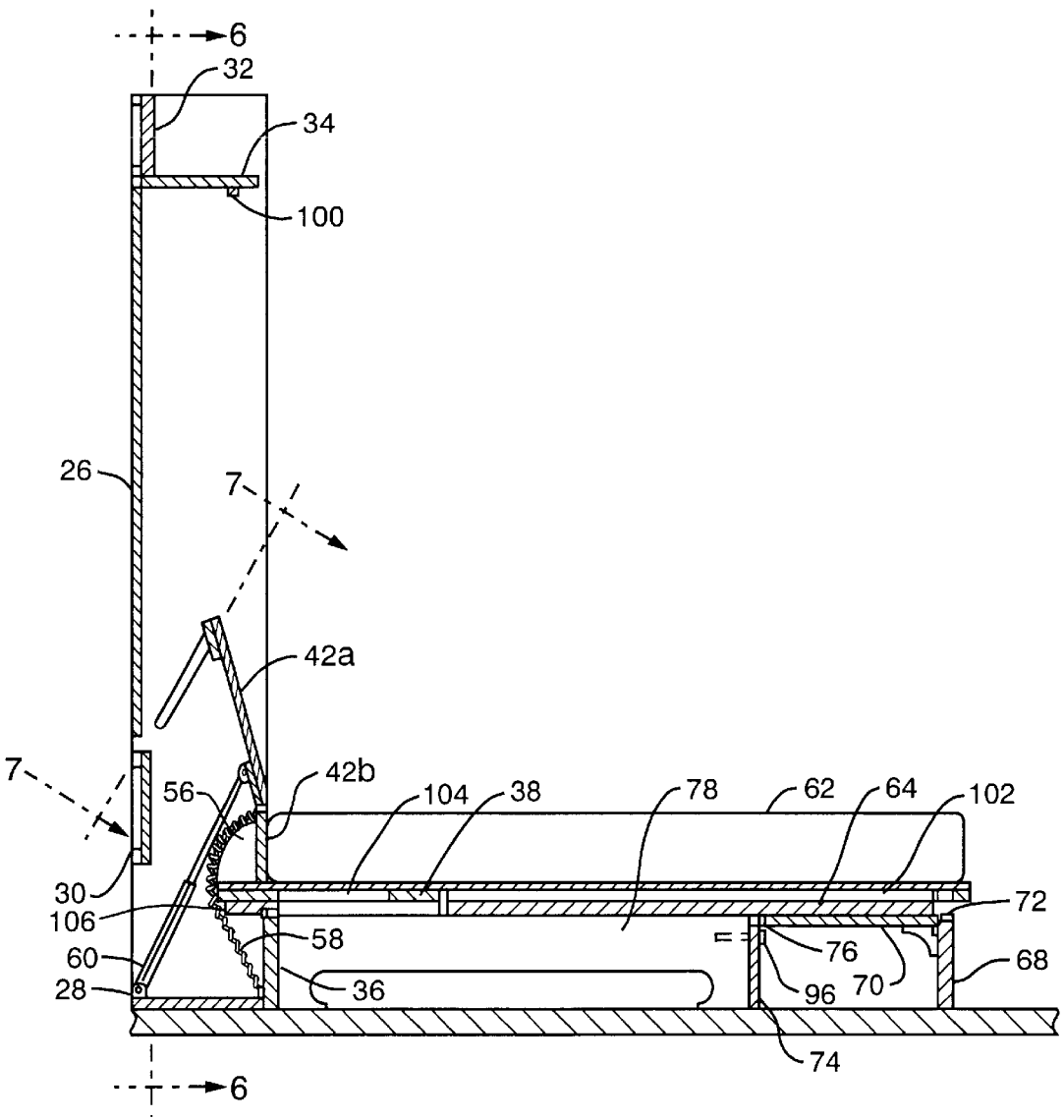
FIG. 5 is a side elevational view, partly in section, showing the bed platform in its functional mode or use position.
Figure 6:
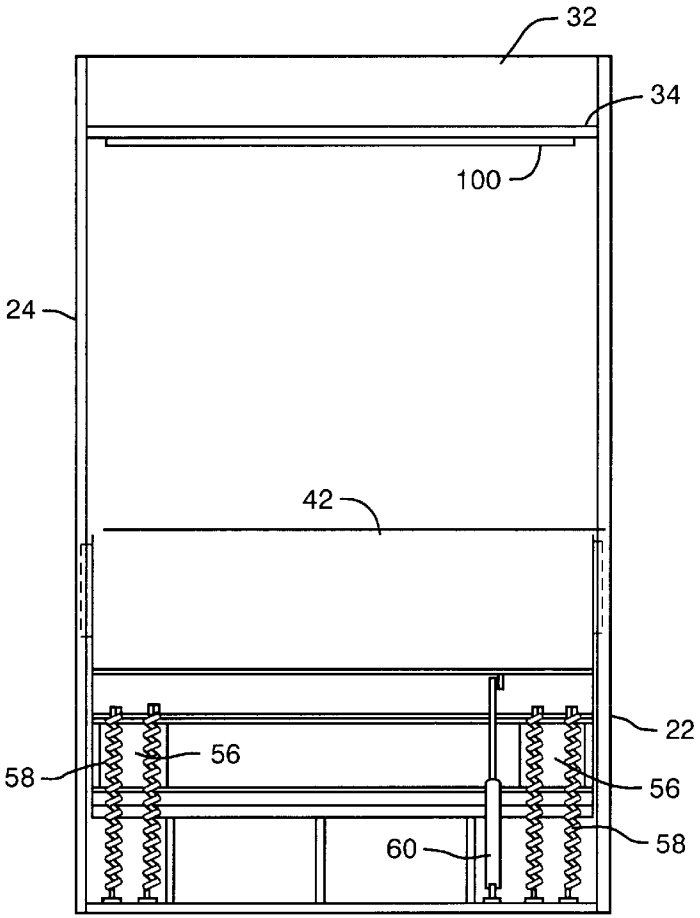
FIG. 6 is a rear elevational view, taken along line 6—6 of FIG. 5.

A set of tension springs 58 are fixedly attached at opposite ends to the respective base plate 28 and to the lower component 42*b* of the head-board 42, as best illustrated in FIGS. 4, 5 and 6. Additionally, an optional damping element 60, such as a hydraulic cylinder and interacting slidable piston, is attached to the base plate 28 and the upper component 42*a* of the head-board 42. This damping element is optional and is not necessary in all embodiments of the invention. The springs 58 are registered with and stretched over the curvilinear surface of the block 56 for transmitting a spring force vector that is coincidental to a longitudinal axis of the bed platform. The curved surface of the block 56 is preferably covered with a wear-resistant, low-friction material such as smooth sheet metal, a Teflon coating or a similar material. A grease coating over the sheet metal cover may also be used. The springs 58 provide a mechanical assist on lowering and raising the bed platform 38 and the optional damping element 60, if included, provides a cushioning effect that absorbs the impact force and reduces vibration when the bed platform 38 is returned to the stowed position. As will be apparent later in this disclosure, other tensioning means are also possible.

Figure 11:
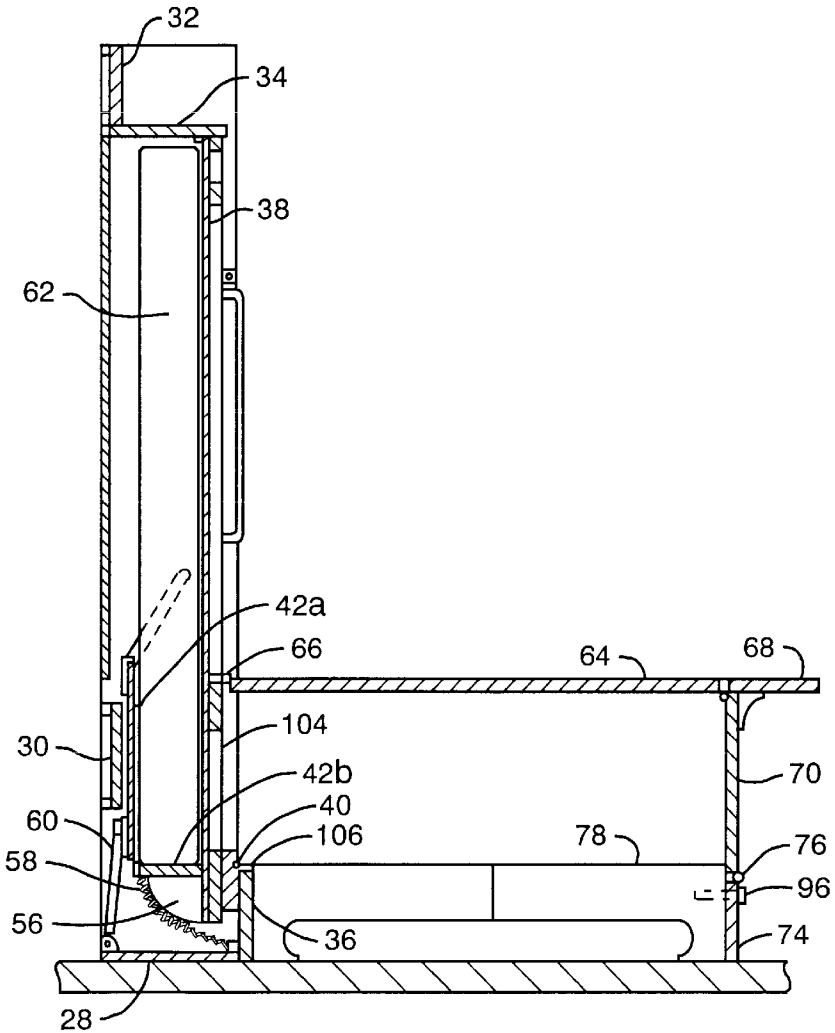
FIG. 11 is a side elevational view in section taken along line 11—11 of FIG. 10 showing the bed platform and the mattress in the stowed position with the table panel in the functional mode.

The spring constant, number and placement of the springs, resistance of the damping element and other technical specifics can be selected for achieving the desired performance characteristics. The bed platform 38 is dimensioned such that it can accept a standard-size mattress 62. The mattress 62 is retained on the bed frame 38 without the need for a side-board, foot-board or other securement devices. Side-boards, foot-boards and/or other securing means may be used with the invention, however. The backstop 42*b* supports the mattress 62 when it is in the stowed position as shown in FIG. 11.

Returning now to FIG. 1, unit 20 also includes a table panel 64 mounted at a first end thereof to the underside of the bed platform 38 for movement about a second horizontal axis through a pivot connection 66 that is spaced from first axis 40. An extension 68 is connected to an opposite end of the table panel 64. Extension 68 has a depending leg 70 rigidly connected at right angles to the extension 68. As shown in FIG. 4, extension 68 is pivotally connected at a third axis 72 to the opposite end of the table panel 64. The leg 70 includes at its lower extremity a foot 74 pivotally connected at fourth axis 76 to the leg 70. Extension 68, leg 70 and foot 74 together form foot means that support or prop the table panel in both its working and its support positions as will be explained.

Figure 9:
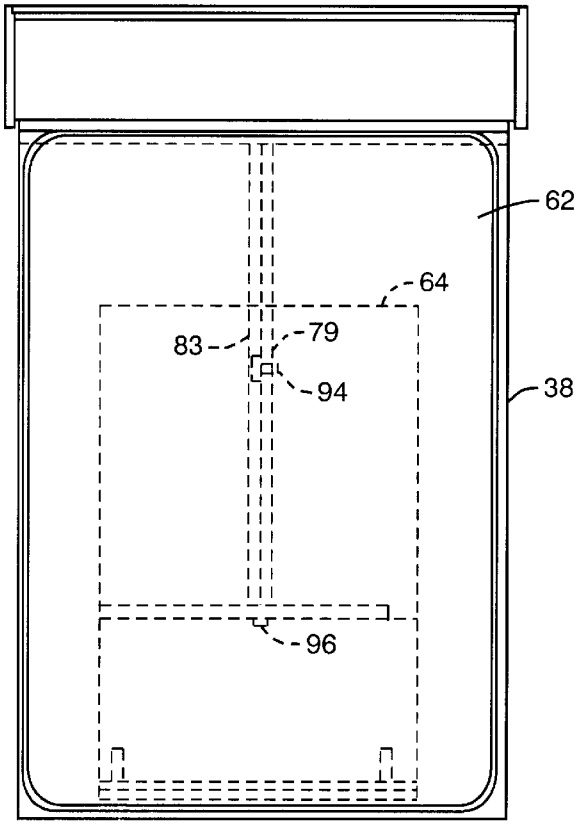
FIG. 9 is a plan view, showing the bed platform and the mattress of FIG. 5 with the table panel and the stiffener assembly shown in broken-line.
Figure 8:
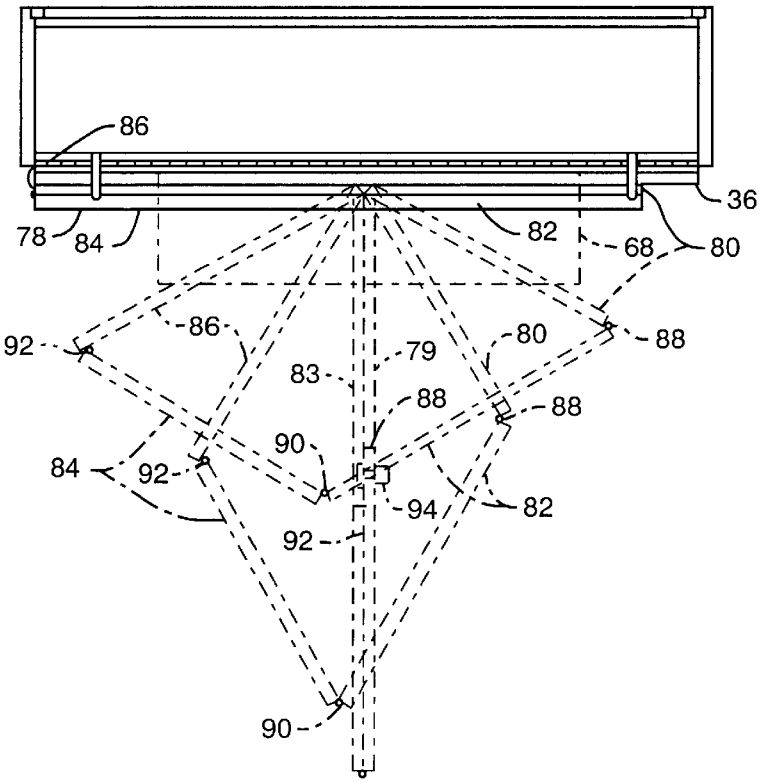
FIG. 8 is a plan view showing the stiffener assembly in a folded position and illustrating, in broken-line, the transitional movement to the fully extended operational mode.

An articulated stiffener assembly or spreader means 78. is utilized for stabilizing the furniture unit 20 against unbalancing forces during movement of the bed platform 38 or the table panel 64. For this purpose, the stiffener assembly 78 is comprised of adjacent leg members One leg member 79 includes leg segments 80, 82, and the other leg member 83 has leg segments 84, 86. The leg segments 80, 82 and 84, 86 are of respectively unequal lengths. The respective leg segments 80, 84 are of substantially equal length, however, as are the leg segments 82, 86 to form an asymmetrical diamond shape when in transitional mode (FIG. 8) The leg segments 80 82 are pivot connected at 88. The leg segments 82, 84 are pivot connected at 90 and the leg segments 84, 86 are pivot connected at 92. Additionally, the leg segments 80 and 86 are pivotally connected at a proximal end to the sill plate 36. The respective leg segments 80, 82, 84, 86 are adapted to fold flush against the sill plate 36 as shown in FIGS. 1 and 2. When the leg segments 80, 82, 84, 86 are forwardly extended, as shown. by the broken-line illustration in FIGS. 8 and 9, the asymmetric configuration creates an overlap of the corresponding pivot connections 88, 92 of the adjacent leg members 79, 83 to provide for structural rigidity. Additionally, a fastener element 94 is secured laterally through the adjacent leg members 79, 83. A quick release lock, such as a conventional quarter-turn locking bolt 96, projects through the foot member 74 for attachment to a distal end of the leg members 79, 83 for providing stability. The leg members 79, 83 are also provided with a captive nut (not shown) or similar fitting to accommodate the locking bolt 96.

Figure 10:
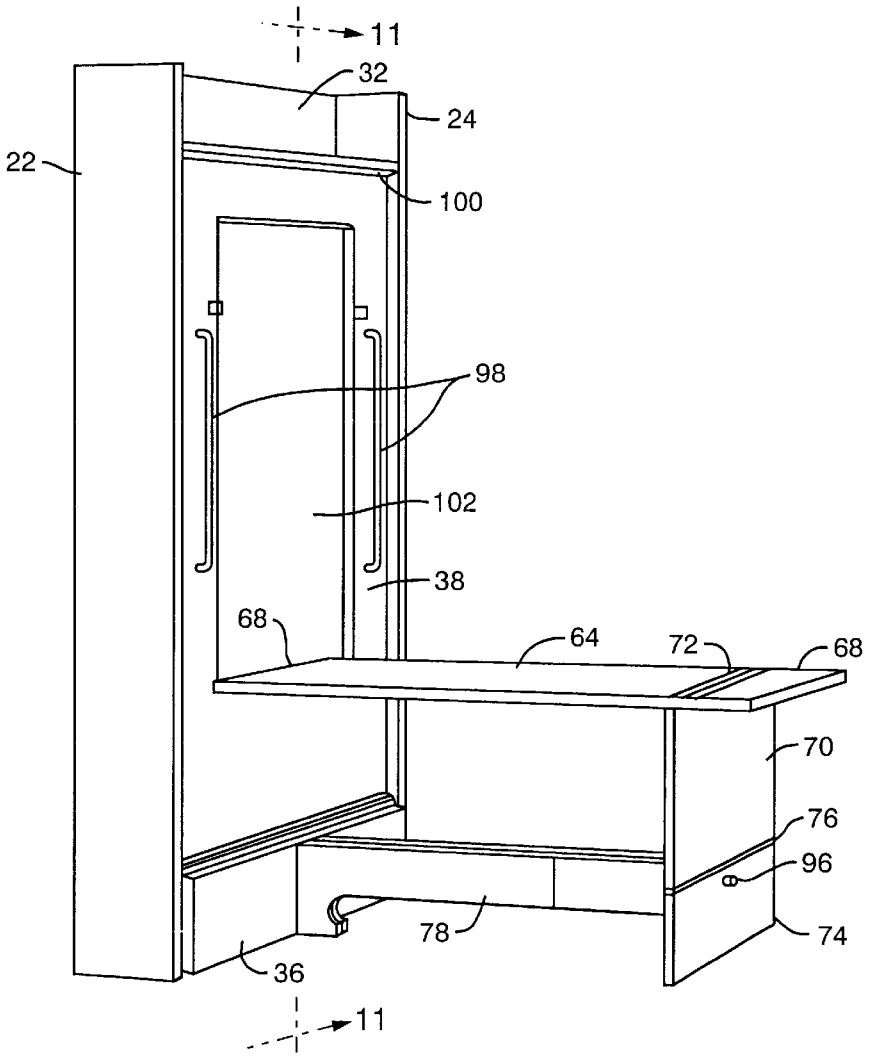
FIG. 10 is a perspective view showing the table panel in the extended functional mode or working position.

The operation of the furniture unit 20 will now be described with reference to FIG. 1. The table panel 64 is lowered by grasping and pulling the extension member 68. forwardly as shown by the arrow and broken-line illustration. Preferably, the articulated stiffener assembly 78 is first extended forwardly from the folded position adjacent the sill plate 36, as shown by the broken-line illustration and arrow. The table panel 64, when fully deployed, is supported at one side, by the pivot connection 66 and at the opposite side by the extension member 68, having the depending leg panel 70 and the integral foot member 74 at the lower extremity of the leg panel 70. Additionally, the stiffener assembly 78 is anchored to the foot member 74 by use of the locking bolt 96 as for example, is shown in FIG. 10.

When it is desired to lower the bed platform 38, a hand-bar 98 is moved forwardly and the bed platform 38 is urged downwardly. The gravitational forces are counterbalanced by the resistance of the springs 58 as best shown in FIG. 4. The table panel 64 concurrently moves forwardly as the extension member 68, the leg panel 70, and the foot member 74 are foldable about the respective pivot connections 72, 76 to assume a kneeling or lowered load-bearing position as shown in FIG. 5. Note that the leg panel 70 will lie under the table panel. 64 and will, bridge between the foot member 74 and the extension member 68. Furthermore, as the bed, frame 38 is lowered, the head-board 42 is deployed through the slidable action of the guide rods 44, 46 within the respective angular slots 48, 50 so as to assume the position shown in FIG. 5.

When it is desired to stow the respective components, the stiffener assembly 78 is released by removing the locking bolt 96 and the fastener 94. The respective leg members 79, 83 are foldably retracted for placement adjacent the sill plate 36. The bed platform 38 is then lifted conjointly with the table panel 64. The damping element 60 cushions the bed platform 38 impact during docking in the stowage mode.

A lip 100 depending from the shelf member 34 is adapted to engage with the uppermost extremity of the bed frame 38 as shown in FIG. 11 and to stop the rearward movement of the bed frame 38. An optional safety latch (not shown) can be utilized to secure the bed platform 38 and the table panel 64 in the stowed mode.

By way of further example, the furniture unit 20 may be constructed of solid lumber, glued laminated lumber, plywood, or similar materials and the respective components can be joined together with doweled joints, screws, and/or dovetail connectors. The pivot connections throughout are preferably hinge connectors, such as a "piano" hinge, tape hinge, double-leaf hinge or equivalent. The hinge may be a sole-called "invisible" hinge or knife hinge.

It should be additionally noted that the bed platform 38 has a lightweight construction design that includes a recessed area 102, suitable for mounting a mirror and/or for attaching artwork or other decorative materials. The articles mounted in the recessed area 102 do not need to be removed when the bed platform 38 is in the functional or the storage modes. The table panel 64 will lie above the recessed area 102 as best shown in FIGS. 2 and 5. The bed platform 38 is also provided with hollow compartments 104 for weight reduction, As more particularly shown in FIG. 2, the table panel 64 is pivotally mounted at 66, over the recessed area 102, and therefore a spacer member 106, having a compensating dimension equal to the thickness dimension of the table panel 64, is utilized to provide a horizontally level plane for supporting the bed platform 38 in its position shown in FIG. 5. The table panel 64 can also be provided with drawers (not shown) for desk use When the bed platform 38 is in the functional mode, the back panel 26 is visible and may be mirrored or provided with decorative artwork. The shelf member 34 can be utilized for storage of books, plants or similar articles.

The furniture unit 20 is self-supporting when in a storage mode and does not need to be attached to the floor or wall; thus no special installation is required and the furniture unit 20 can be repositioned in the room as desired.

Figure 12:
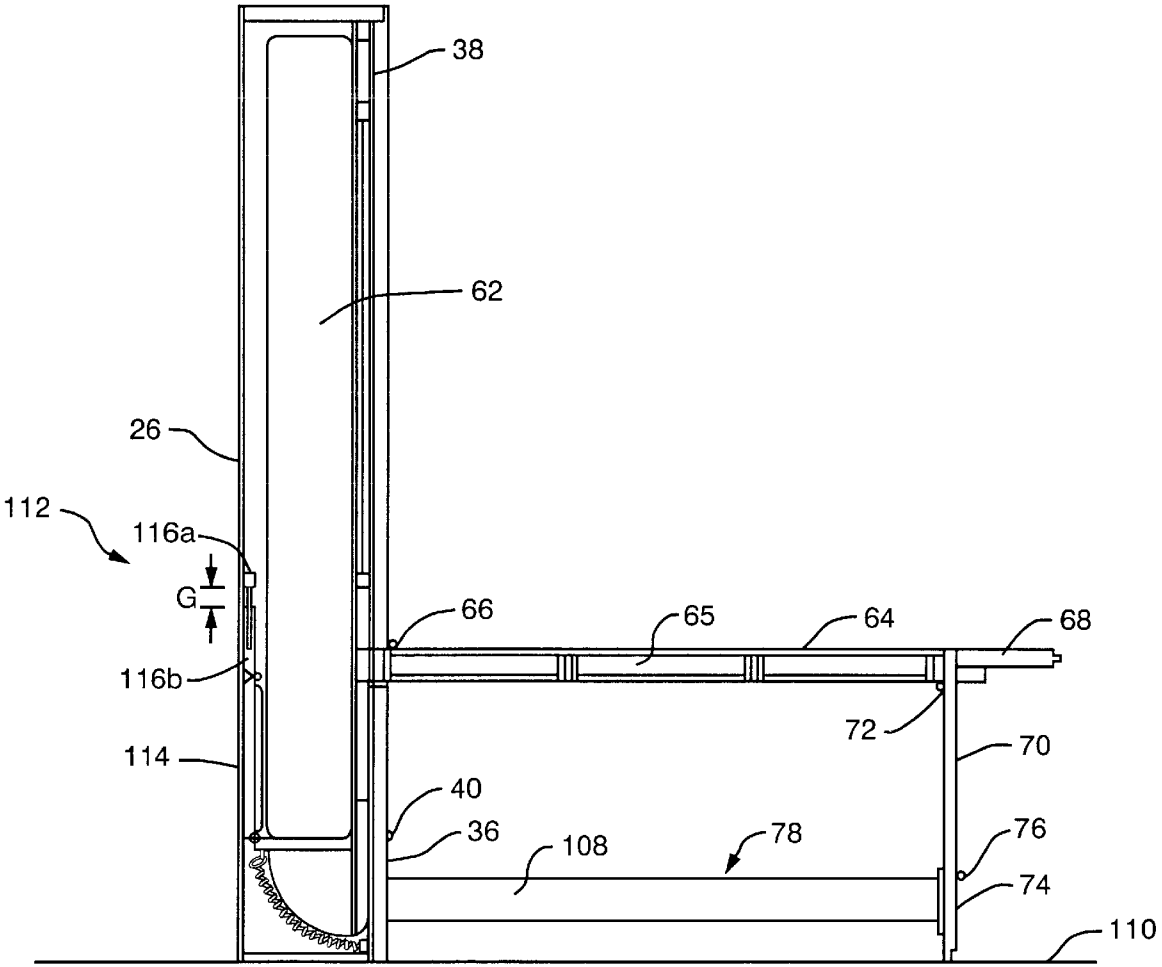
FIG. 12 is a side sectional view of a second embodiment of the invention in a working position for the table panel and a stowed position for the mattress platform.
Figure 13:
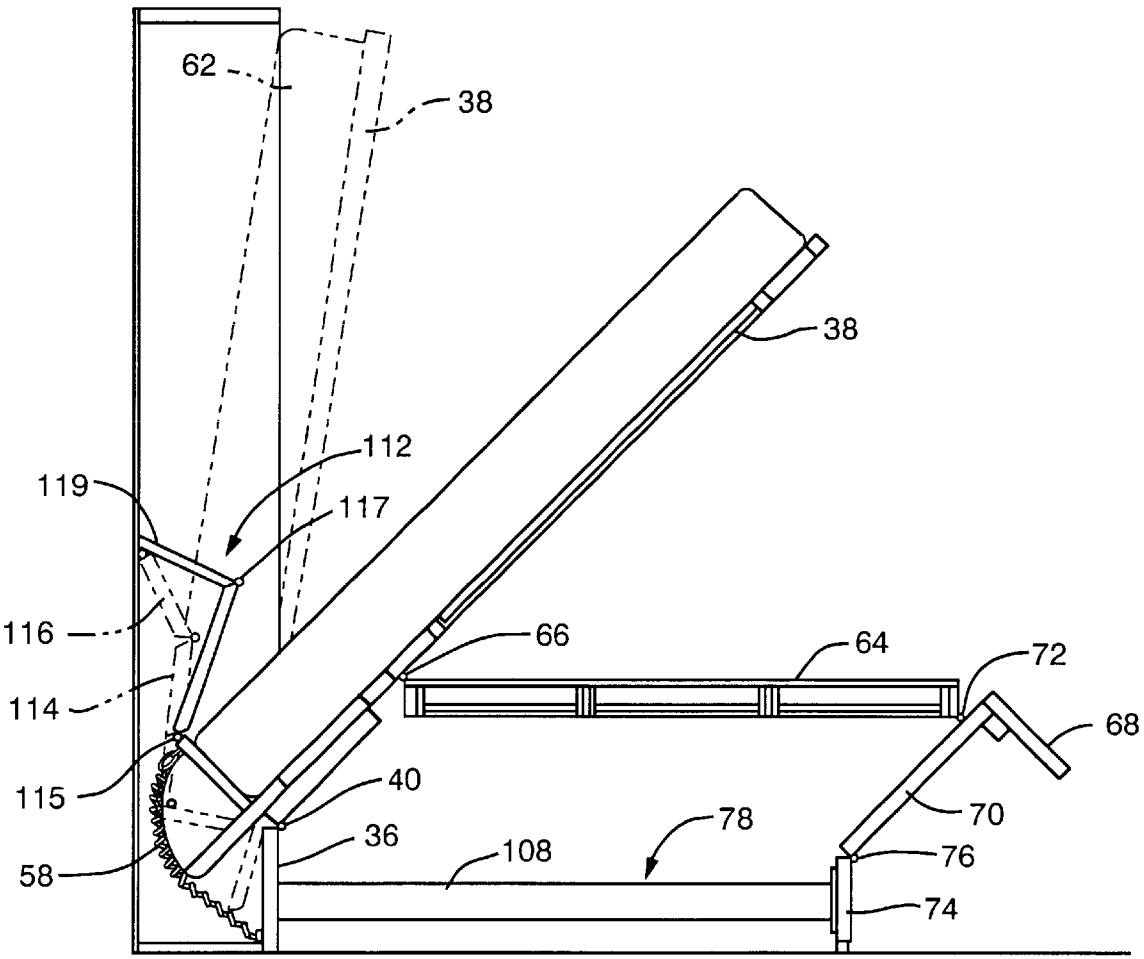
FIG. 13 is a view similar to FIG. 4 showing a transitional position of the unit.
Figure 14:
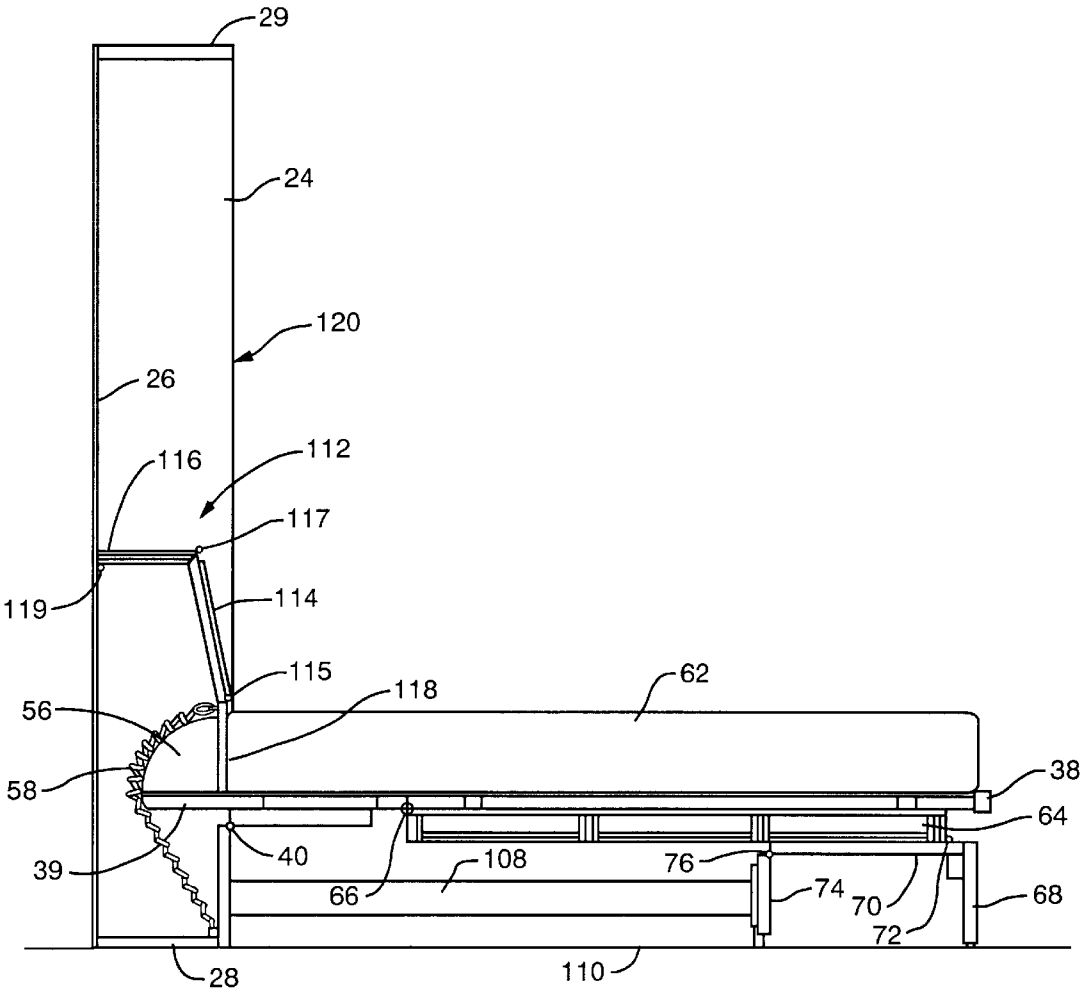
FIG. 14 is a view similar to FIG. 5 showing the unit in a use position for the mattress platform and a support position for the table panel.
Figure 15:
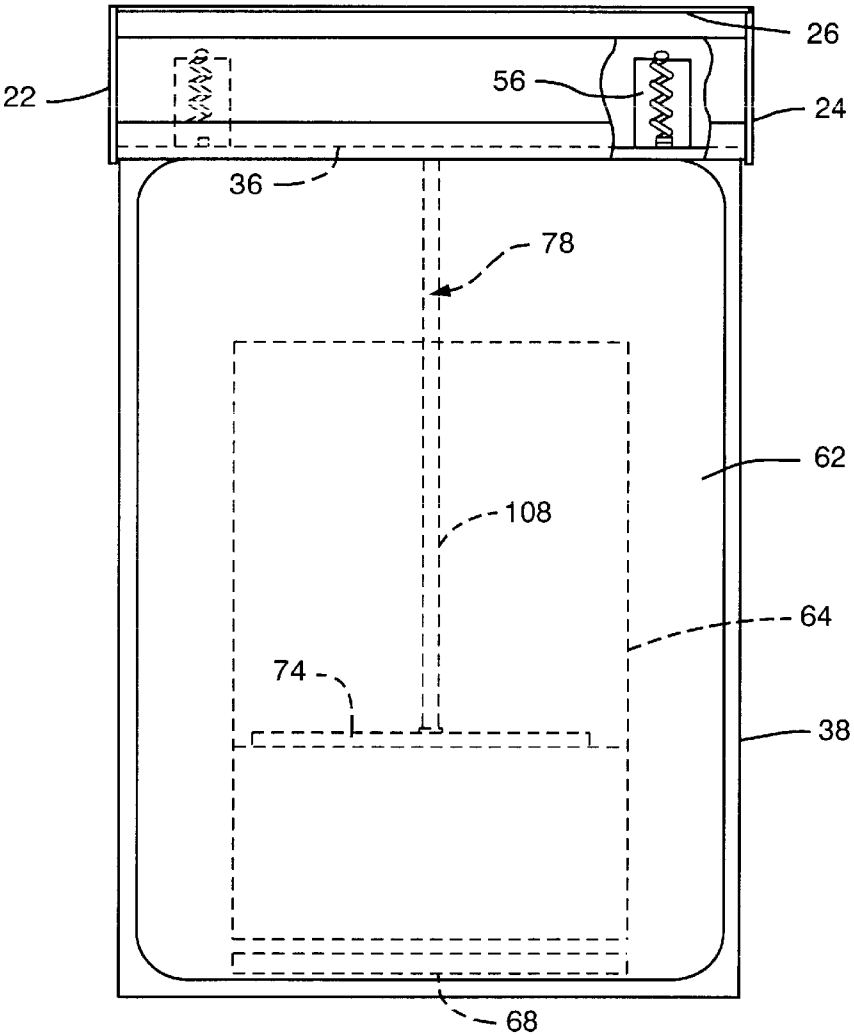
FIG. 15 is a top plan view of the unit of FIG. 14 in the use position for the mattress platform and with a portion cut away to show part of the tensioning mechanism.

FIGS. 12–18 disclose further embodiments of the invention which have many similar features to the first embodiment of FIGS. 1–10, but which has one major distinction involving the spreader means generally designated 78, best shown in FIGS. 12 and 15. Unlike the embodiment of FIG. 1 which utilizes spreader means 78 in the form of an articulated stiffener assembly, the spreader means 78 in the embodiment of FIGS. 12–17 comprises a strong tube 108, preferably made of metal such as steel or aircraft aluminum and connected at its first end to the sill plate 36 and at its opposite end to foot 74. Both of these connections are preferably through flanges welded to the opposite ends of tube 108, the flanges being bolted or screwed to the respective sill plate and foot, 36, 37, 74. The inventor has found that by utilizing a fixed spreader means of FIG. 12, rather than the articulated spreader means of FIG. 1, the unit is truly self-supporting and free-standing. Even under the extreme rotational forces that are placed on the base while the bed-platform is moved from its stowed position of FIG. 12 through its intermediate position of FIG. 13 and its use position of FIG. 14, there is no danger that the base to which the bed platform is pivotally connected will itself rotate. The tendency of the base to rotate is blocked by the spreader means 78 and, specifically, by a downward counteracting force of foot 74 on the floor, shown at 110.

Figure 18:
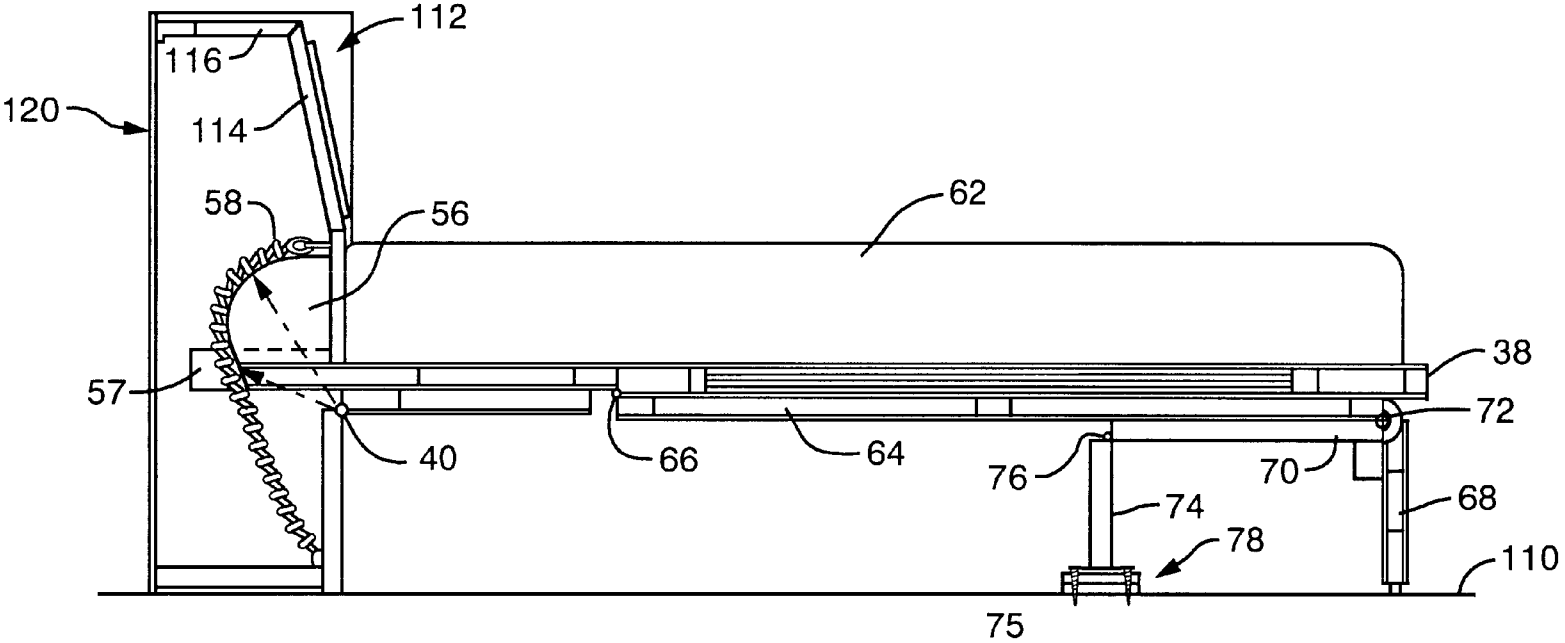
FIG. 18 is a side sectional view of a further variant of the embodiment of FIG. 16 in a use position for the mattress platform.

In the embodiment of FIG. 18, the spreader function is instead served by a plate 75 that fixes the foot 74 to the floor 110, e.g. using screws.

Another distinction between the embodiment of FIG. 1 and that of FIG. 12 is that the table panel 64 cannot be raised to a stowed or stored position which is possible for the embodiment of FIG. 1, but either is in its working position shown in FIG. 12 or its lowered support position shown in FIG. 14 where the upper surface of table panel 64 supports the lower surface of bed platform 38. Both foot 74 and extension 68 support the far end of the bed platform 38 on the floor 110.

Another feature of the embodiment of FIGS. 12–15 is the fact that table panel 64 is actually a three dimensional structure which includes spaces 65 that can receive drawers, or act as storage areas.

To maintain the parallelogram geometry of the invention which permits the unit to move from its table orientation in FIG. 12 to its bed orientation in FIG. 14, it is also significant that the table panel 64 is pivotally connected to the under-surface of bed platform. 38 at the second axis 66 which is near an upper surface of panel 64. The third axis 72, between panel 64 and the leg means 68, 70, 74, must be near the bottom surface of 64. If this selected locationing of axes 66, 72 is not observed, the unit will not be able to fully attain the positions in FIG. 12 or 14, or both (that is the parallelogram will "bind"). It is also significant that the spacing between first and second axes 40, 66 is equal to the spacing between third and fourth axes 72, 76, which spacing equals the length of leg 70. The combined length of foot 74 and leg 70 when the table is in its working position of FIG. 12 also establishes the total vertical height of the working surface of panel 64 and is equal to the vertical height of sill plate 36, plus the spacing between first and second axes 40, 66.

The inventor has found that if any of these parameters changed even-slightly, the unit does not operate properly. Changing one parameter also effects all of the other parameters. As an example, in the embodiment of FIGS. 16–18, table panel 64 has no storage space and is simply an engineered panel made of upper and lower laminates with a frame there between. In creating this structure, the inventor carefully relocated all of the pivot axes and lengths of the various other components of the invention to insure operability.

Returning to the embodiment of FIG. 12, another important distinction between the second embodiment of the invention and the first embodiment shown in FIG. 1 is in the construction of the head-board means, generally designated 112. As best shown in FIG. 14, head-board means 112 comprises a head-board 114 having a lower end pivotally connected at a fifth axis 115 to the top of backstop 118, and an opposite upper end connected by a sixth axis 117, to a shelf board 116. The opposite end of shelf-board 116 is connected by a seventh axis 119 to the inner surface of back panel 26 which, in the embodiment of FIGS. 12–15 extends the full height of the base from the base plate 28 to a top plate 29. There may be a break in the back panel 26 to provide access to the springs 58 or a lower panel. portion of back panel 26 may be removable for this same purpose.

The relative lengths of the head-board 114, shelf-board 116, and backstop 118, are determined so that the head-board and shelf-board components unfold from their flat stowed position shown in FIG. 12 to pass through transitional positions shown in FIG. 13, both in solid line and phantom lines, to finally arrive in their use positions shown in FIG. 14. In the embodiment shown in FIGS. 12, 13 and 14, the shelf-board 116 must be in two parts with means for spreading the parts apart from each other by a short distance, and then coming back together. When the platform is in the storage position, these two parts of the shelf are separated from each other by a gap G in FIG. 12. During the first part of the mattress rotation forward, the first thing that happens to the shelf is that this gap between the two parts 116*a*, 116*b* closes. Only after the gap closes does the shelf and head-board assembly start to pivot out toward their use position. Without this additional articulation of the shelf in two parts, the shelf and head-board would be pivoting out into a space that is still being occupied by the mattress. In other words, as-one starts to tilt the platform forward, the closing movement of the shelf-board allows time for the the closing movement of the shelf-board allows time for the mattress to "get out of the way" of the space into which the head-board and shelf are going to unfold.

As one tilts the platform forward, the gap G between the two parts of the shelf start to close. Correspondingly, as one finishes tilting the platform back up to the stored position, the gap reopens. Strong elastic straps between parts 116*a* and 116*b*, tending to close the gap G, are attached across the gap between the two parts of the shelf, which resist the opening of the gap. This allows the final opening of the gap, which happens as the platform is stored, to act as a shock absorber to ease the final part of the travel of the platform.

In the embodiment illustrated, parts 116*a* and 116*b* have corresponding and aligned holes drilled in a number of locations along the mated edges of these parts, e.g. four sets of holes. Rods of metal, plastic or other strong rigid material are fixed into the holes of part 116*a*, e.g. by gluing or screwing. Each rod is long enough so that an opposite free end of each rod slidably extends into the corresponding hole of part 116*b*. In this way parts 116*a*, 116*b* slide with respect to each other to increase and decrease the gap G shown in FIG. 17. Springs, elastic bands or other means are provided to bias parts 116*a*, 116*b* toward each other, and means other than rods in aligned holes can be used to allow shelf-board 116 to "expand" and contract according to the invention. For example, parts 116*a*, 116*b* and can slide in a common track, or be made of flat stock that telescope against each other or other ways can be used that allow parts 116*a*, 116*b* to move apart from each other, forming gap G, and then spring back to close the gap under the influence of biasing means such as a heavy rubber band or other elastic restoring device for pulling parts 116*a*, 116*b* together.

Other embodiments, which use different relationships between the depth of the cabinet, the tilt of the head-board, the height of the head-board, etc. may not need this additional articulation and could have a one-piece shelf-board.

As with the embodiment of FIG. 2, guide block 56 guides the extension of spring 58 around its curved surface. Guide blocks 56, as also shown in FIG. 15, can be augmented or replaced by weights that act as a counterweight to resist rapid dropping of the bed into its use position instead of, or in addition, to springs 58. In FIG. 18 an alternate shape for counterweight 57 is shown.

The curvature of block 56 can also be selected to improve the tensioning characteristics of springs 58 on the downward movement of bed platform 38. Rather than quarter circles as in the embodiment of FIGS. 12–16, the curvature of block 56 can have a cam configuration shown in FIGS. 17 and 18, with greater curvature at the top end of the block than at the other end for slowly increasing the effective biasing of spring 58 as the bed is lowered so that a small amount of biasing force is applied near the top of the stroke when little rotational force is being exerted on first axis 40, to a point later in the stroke when more of the weight of bed platform 38 and mattress. 62 is being applied around first axis 40. The cam surface is also shaped so that the spring force is purposely weakened by decreased mechanical advantage (by a smaller radius at the appropriate part of the cam shape) for approximately the last 10° of rotation to the use position. The purpose of this is to allow strong enough springs to be used to counterbalance the weight of the platform and the table, but still allow the platform to finish the last part of its downward rotational travel and stay firmly down in the use position.

In other words, as one folds the bed down, the table top lands first, while the platform is still up by 10° or so. If strong enough springs are used to fully balance the combined weight of the platform and tabletop, they will be too strong to allow the platform to travel those last 10°, so the platform will actually float back up a bit. The cam shape thus purposely weakens the extra spring strength at the end of the stroke so that the platform lands positively.

In the embodiments of the invention where block 56 is a counterweight, the block may be in the form of a plastic reservoir to be filled by water by the user, or by a metal weight, such as a lead weight with a protective covering of a non-toxic material.

Figure 16:
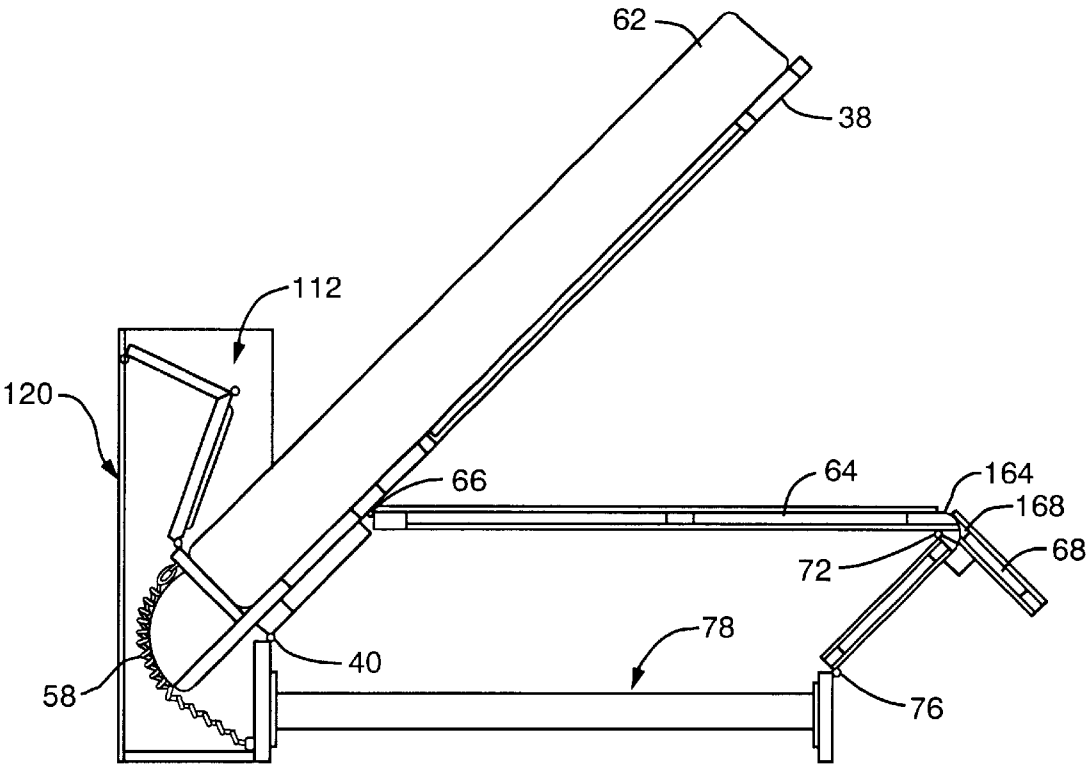
FIG. 16 is a view similar to FIG. 13 but of a third embodiment of the invention.
Figure 17:
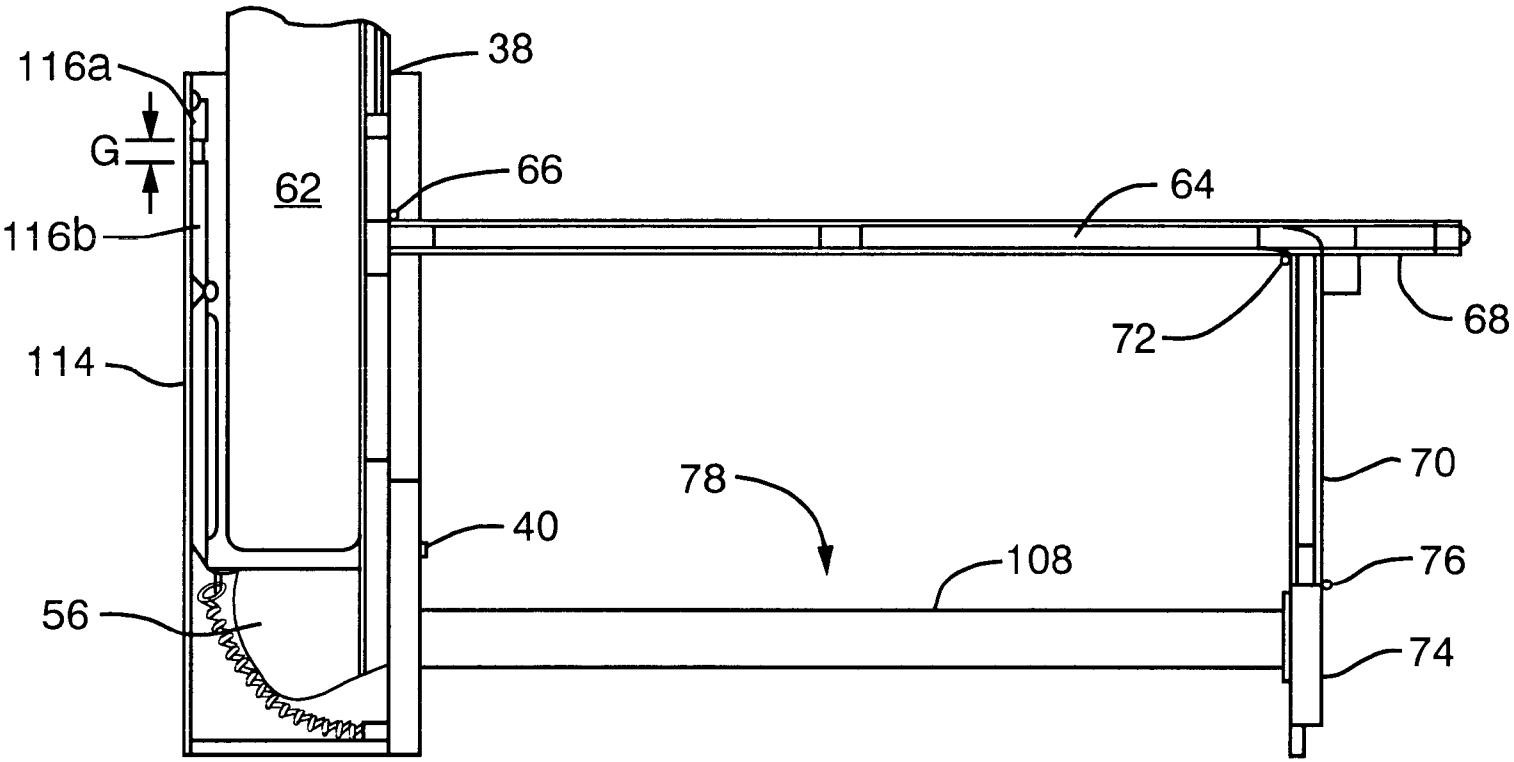
FIG. 17 is a partial side sectional view of a variant of the embodiment of FIG. 16 in the working position for the table panel.

FIGS. 16–18 show a further embodiment of the invention where the base generally designated 120 is only as high as the baseboard means 112 in its use position of FIG. 18. In this embodiment of the invention, most of the length of the mattress 62, with its bed platform 38, will extend above base 120 in the stowed position, partially shown in FIG. 17.

Another feature of the embodiments of FIGS. 16–18 is the fact that the outer end 164 of table panel 64 has a semi-circular curve, as in a drop-leaf table joint, which engages in a semi-circular recess 168 in the adjoining end of extension 68. This, in conjunction with the fact that the second and third horizontal axes 66, 72 are positioned at respective top and bottom surfaces of panel 64, produce an elegant, closely fitting arrangement that is also esthetically pleasing and adds safety by reducing the size of the potential pinching area. As with the embodiment of FIG. 12, the embodiment of FIG. 16 is free-standing and no part of the base 120 need be attached to the wall or floor without any loss of stability in either working or use position for the table and bed and in any intermediate position exemplified by FIG. 16.

A, still further embodiment of the invention (not shown) utilizes a spreader means in the form of an articulated stiffener assembly shown in FIG. 1 using only a single stiffener member that is folded in half or is completely replaced by a fitting 75 on the floor which is removably attached to the foot 74 or, as in FIG. 18, fixed to foot 74.

It is noted that in all the embodiments of the invention, the bed platform 38 includes an extension 39 that extends into the base 120 and acts as a support for the blocks 56. Platform extension 38 extends behind backstop 118 and has a curved lower edge in the embodiments of FIGS. 12–14, which continues the curvature of block 56 to allow smooth extension and contraction of spring 58.

While specific embodiments of the invention have been shown and described in detail to illustrate the application of the principles of the invention, it will be understood that the invention may be embodied otherwise without departing from such principles.

What is claimed is:

1. A convertible furniture unit, comprising:

a base;

a bed platform pivotally connected to the base for angular displacement about a first axis from an upright stowed position with respect to the base, to a substantially horizontal use position, the platform having an upper surface in the use position that is adapted to support a mattress, and an opposite surface;

a table panel having a first end pivotally mounted to the opposite surface of the platform for relative displacement between the platform and the panel about a second axis which is spaced from the first axis so that the panel is in a support position when the platform is in the use position, and the panel is in a working position when the platform is in the stowed position; and a foot pivotally connected to the table panel at a location that is spaced from the first end of the panel, for rotation of the foot between an upper position for propping the panel in its working position, and a lower position, about a third axis which is spaced from the first and second axes, the foot including a foot portion for supporting the panel in the support position when the foot is in the lower position;

the foot comprising a leg, an,extension fixed to the leg and extending from the leg substantially perpendicularly, the extension and leg being pivotally connected to the table panel at the third axis, and the foot portion located at affixable spacing from the base, the foot portion being pivotally connected at a fourth axis to the leg, the fourth axis being spaced from the third axis by a distance equal to a spacing between the first and second axes.

2. A unit according to claim 1, including a spreader for fixing a position between at least part of the foot and the base when the bed platform is in the use position.

3. A unit according to claim 2 wherein the spreader is fixed between the base and the foot.

4. A unit according to claim 2 wherein the spreader comprises an articulated stiffener assembly which is movably mounted to the base and extendable to fix a spacing between the base and the foot when the table panel is in its support position.

5. A unit according to claim 1 including fixing means for fixing the spacing between the base and the foot portion.

6. A unit according to claim 1 including articulated stiffening means movably connected to the base for fixing a spacing between the base and the foot portion.

7. A unit according to claim 1 including tensioning means operatively connected to the bed platform for resisting movement of the bed platform from its stowed position to its use position.

8. A unit according to claim 7 wherein the tensioning means comprises at least one spring connected between the base and the bed platform.

9. A unit according to claim 8 including a block having a curved surface over which at least part of the spring extends for controlling biasing force of the spring being applied to the bed platform as the bed platform moves between its stowed and use positions.

10. A unit according to claim 7 wherein the tensioning means comprises a counterweight.

11. A unit according to claim 1 wherein said table panel has upper and lower surfaces, said second axis being adjacent the upper surface of the table panel and the third axis being adjacent the lower surface of the table panel.

12. A unit according to claim 11 including a spreader for fixing a position between the base and the foot with the bed platform in its use position.

13. A unit according to claim 1 including a head-board assembly movably mounted between the base and the bed platform for forming a head-board when the bed platform is in the use position.

14. A unit according to claim 13 wherein the bed platform includes a backstop fixed to the platform at a location adapted to establish a mattress position on the platform, the head-board assembly comprising a head-board pivotally connected to the backstop and a shelf-board pivotally connected between the head-board and the base, the head-board and shelf-board being at an angle to each other in the use position of the platform, and being substantially co-planar in the stowed position of the platform.

15. A unit according to claim 13 including a backstop fixed to the platform at a location adapted to set a position of a mattress on the platform, and the head-board assembly including a head-board pivotally connected to the backstop, the base including a slot for guiding movement of the head-board between the stowed position and the use position of the platform.

16. A unit according to claim 1 wherein the table panel contains at least one space for receiving a drawer or for storage.

17. A unit according to claim 1 wherein the platform includes a recess in its opposite surface, adapted to receive a mirror or other flat item.

18. A transfigurable furniture unit comprising a bed platform pivotally connected to a base member for angular displacement about a horizontal axis from an upright stowed position to a substantially horizontal functional mode, said bed platform being adapted to support a mattress on an upper surface, a table panel mounted along a first edge to an underside of the bed platform for angular displacement about a horizontal axis when the bed platform is in the stowed position to a first functional mode, said table panel including an extension member pivotally connected to a second edge of the table panel, said extension member having a depending leg panel adapted to support the table panel in the first functional mode, said extension member and leg panel being pivotally foldable to a platform support mode when the bed platform is displaced to the functional mode, the leg panel defining a foot member at a lower extremity, said foot member being hingedly connected to the leg panel, said foot member and said extension member being adapted for supporting the leg panel under the table panel when in the platform support mode.

19. A transfigurable furniture unit comprising a bed platform pivotally connected to a base member for angular displacement about a horizontal axis from an upright stowed position to a substantially horizontal functional mode, said bed platform being adapted to support a mattress on an upper surface, a table panel mounted along a first edge to an underside of the bed platform for angular displacement about a horizontal axis when the bed platform is in the stowed position to a first functional mode, said table panel including an extension member pivotally connected to a second edge of the table panel, said extension member having a depending leg panel adapted to support the table panel in the first functional mode, said extension member and leg panel being pivotally foldable to a platform support mode when the bed platform is displaced to the functional mode, a headboard having a first and a second component with the first component being attached at one end to an upper surface of the bed platform and the second component being hingedly connected to another end of the first component, said second component being adapted for slidable displacement concurrently with the movement of the bed platform, the second component of the headboard being provided with at least one projection extending laterally from the headboard, said projection being adapted for slidable accommodation within a track for defining a path of travel for the headboard during deployment of the bed platform.

20. A transfigurable furniture unit comprising a bed platform pivotally connected to a base member for angular displacement about a horizontal axis from an upright stowed position to a substantially horizontal functional mode, said bed platform being adapted to support a mattress on an upper surface, a table panel mounted along a first edge to an underside of the bed platform for angular displacement about a horizontal axis when the bed platform is in the stowed position to a first functional mode, said table panel including an extension member pivotally connected to a second edge of the table panel, said extension member having a depending leg panel adapted to support the table panel in the first functional mode, said extension member and table panel being pivotally foldable to a platform support mode when the bed platform is displaced to the functional mode, spring biasing means for transmitting a spring force coincidental to a longitudinal axis of the bed platform to provide a mechanical assist upon lowering and raising the bed platform, the spring biasing means includes a block mounted to the bed platform and defining a curvilinear surface and a spring member registrable with and stretchable over the curvilinear surface.

21. A transfigurable furniture unit comprising a bed platform pivotally connected to a base member for angular displacement about a horizontal axis from an upright stowed position to a substantially horizontal functional mode, said bed platform being adapted to support a mattress on an upper surface, a table panel mounted along a first edge to an underside of the bed platform for angular displacement about a horizontal axis when the bed platform is in the stowed position to a first functional mode, said table panel including an extension member pivotally connected to a second edge of the table panel, said extension member having a depending leg panel adapted to support the table panel in the first functional mode, said extension member and leg panel being pivotally foldable to a platform support mode when the bed platform is displaced to the functional mode, an articulated stiffener assembly for stabilizing the furniture unit, said stiffener assembly being extendable from a stowed position adjacent the base member to an extended position forwardly of the base member, the articulated stiffener assembly comprising an asymmetric arrangement of hingedly segmented leg members, the respective leg members being hingedly connected at a proximal end to the base member and when extended are attachable at a distal end to the leg panel.

22. A transfigurable furniture unit comprising a bed platform pivotally connected to a base member for angular displacement about a horizontal axis from an upright stowed position to a substantially horizontal functional mode, said bed platform being adapted to support a mattress on an upper surface, a table panel mounted along a first edge to an underside of the bed platform for angular displacement about a horizontal axis when the bed platform is in the stowed position to a first functional mode, said table panel including an extension member pivotally connected to a second edge of the table panel, said extension member having a depending leg panel adapted to support the table panel in the first functional mode, said extension member and leg panel being pivotally foldable to a platform support mode when the bed platform is displaced to the functional mode, the base member including a base plate, a sill plate extending upwardly at right angles to a base plate, a spacer member attached to the underside of said bed platform, said spacer member being hingedly connected to an upper edge of the sill plate.

23. A transfigurable furniture unit as claimed in claim 22, wherein said spacer member has a compensating dimension substantially corresponding to the thickness dimension of the table panel.

24. A convertible furniture unit, comprising:

a base;

a bed platform pivotally connected to the base for angular displacement about a first axis from an upright stowed position with respect to the base, to a substantially horizontal use position, the platform having an upper surface in the use position that is adapted to support a mattress, and an opposite surface;

a table panel having a first end pivotally mounted to the opposite surface of the platform for relative displacement between the platform and the panel about a second axis which is spaced from the first axis so that the panel is in a support position when the platform is in the use position, and the panel is in a working position when the platform is in the stowed position;

a foot pivotally connected to the table panel at a location that is spaced from the first end of the panel, for rotation of the foot between an upper position for propping the panel in its working position, and a lower position, about a third axis which is spaced from the first and second axes, the foot including a foot portion for supporting the panel in the support position when the foot is in the lower position; and a backstop connected to the bed platform at a location adapted to fix a position of a mattress on the bed platform in the stowed position, the bed platform including an extension extending into the base, a block with a curved surface mounted on the platform extension, and at least one spring connected between the base and the backstop and extending across the curved surface, the spring being extended when the platform moves from its stowed position to its use position for resisting movement of the platform to its use position.

25. A unit according to claim 24 wherein the curvature of the curved surface of the block is selected to control biasing forces applied to the bed platform by the spring.

26. A convertible furniture unit, comprising:

a base;

a bed platform pivotally connected to the base for angular displacement about a first axis from an upright stowed position with respect to the base, to a substantially horizontal use position, the platform having an upper surface in the use position that is adapted to support a mattress, and an opposite surface;

a table panel having a first end pivotally mounted to the opposite surface of the platform for relative displacement between the platform and the panel about a second axis which is spaced from the first axis so that the panel is in a support position when the platform is in the use position, and the panel, is in a working position when the platform is in the stowed position;

a foot pivotally connected to the table panel at a location that is spaced from the first end of the panel, for rotation of the foot between an upper position for propping the panel in its working position, and a lower position, about a third axis which is spaced from the first and second axes, the foot including a foot portion for supporting the panel in the support position when the foot is in the lower position;

tensioning means operatively connected to the bed platform for resisting movement of the bed platform from its stowed position to its use position, the tensioning means comprising at least one spring connected between the base and the bed platform; and a block having a curved surface over which at least part of the spring extends for controlling biasing force of the spring being applied to the bed platform as the bed platform moves between its stowed and use positions.

* * * * *